US005185940A

United States Patent [19]

Fleissner

[11] Patent Number: 5,185,940

[45] Date of Patent: Feb. 16, 1993

[54] DEVICE FOR THROUGH-FLOW PROCESSING OF WEB MATERIAL

[75] Inventor: Gerold Fleissner, Chur, Switzerland

[73] Assignee: Fleissner Maschinenfabrik AG, Rebstein, Switzerland

[21] Appl. No.: 696,964

[22] Filed: May 8, 1991

[30] Foreign Application Priority Data

Jul. 13, 1990 [DE] Fed. Rep. of Germany ..... 4022336

[51] Int. Cl.[5] ..... F26B 11/02

[52] U.S. Cl. ..... 34/115; 34/23; 34/114

[58] Field of Search ..... 34/113, 114, 115, 116, 34/23, 110, 122, 123

[56] References Cited

U.S. PATENT DOCUMENTS

| | | | |
|---|---|---|---|
| 3,476,367 | 11/1969 | Fleissner | 34/115 |
| 3,510,955 | 5/1970 | Fleissner | 34/115 |
| 3,512,265 | 5/1970 | Fleissner | 34/115 |
| 5,021,241 | 6/1991 | Yamahira et al. | 34/115 |

*Primary Examiner*—Henry A. Bennet
*Assistant Examiner*—Denise L. F. Gromada
*Attorney, Agent, or Firm*—Antonelli, Terry, Stout & Kraus

[57] ABSTRACT

In a screen drum device with a fan mounted endwise for generating suction through the screen drum surface, in front of a screen drum jacket, a baffle cover is usually provided. This baffle cover generates in a baffle chamber in front of the baffle cover, the accumulated pressure which is required for uniform processing of a web of material. In order to be able to handle optimally webs of different widths on the screen drum, the baffle cover in the vicinity of the narrow width of the goods is made so that it can be either removed completely or is given an opening mechanism, or the baffle cover has an additional screen cover located parallel thereto and displaceable with respect to the baffle cover. The holes in the baffle cover and screen cover are so arranged with respect to one another that when displacement by about one hole division takes place, most of the holes in the baffle cover can be covered by the ribs or non-permeable portions adjacent to the holes of the screen cover in order to be able to dry the material in the remaining part.

30 Claims, 3 Drawing Sheets

DEVICE FOR THROUGH-FLOW PROCESSING OF WEB MATERIAL

BACKGROUND OF THE INVENTION

This invention relates to a device for through-flow process of web-form fabric, fleece, paper, tissue or the like with a fluid but especially gaseous, processing medium circulated throughout the entire device by a fan, with a permeable, e.g. a screen drum, traversed from the exterior to the interior and placed in a vacuum and having non-perforated walls at the ends, said drum serving as a transport element for the web-form material, which, to form the processing medium baffle chamber in front of a processing chamber, has associated with its a baffle cover with perforations, axially parallel to the drum, said perforations being arranged crosswise over the working width of the drum, the processing medium permeability of said cover being less than that of the drum.

A screen drum design of this type is known. The baffle cover is required to distribute the recirculated fluid upstream from the processing chamber, in which the screen drum is rotatably mounted, uniformly over the working width of the drum, so that it then flow perpendicularly to the surface of the screen drum, in equal air flow volumes to the screen drum. This produces a uniform temperature distribution over the working width of the screen drum. The jacket or cylindrical casing for the screen drum can be made from a piece of perforated sheet metal over which a braided screen can be wrapped to even out the air flow through the perforations. The air permeability of this sheet metal jacket, however, is limited to approximately 45% of the total surface of the drum because of the ribs between the holes or perforations required for stability of the jacket. Drums whose jackets are composed of sheet metal strips extending radially are better. These drums, which are up to 96% permeably, are used especially for drying paper and fleece.

When such screen drum designs are used, material webs of different widths must be handled. In order to limit the air flow to the width of the material web, the marginal areas of the drum which are not covered by the web of material to be treated can be covered in known fashion by an air-impermeable cloth. This method is too cumbersome, however, especially when the working width of the material changes rapidly It is also known from DE-OS 19 00 496 to limit the inflow area to the working width by using walls which are located outside the screen drum and which form a seal with the baffle cover. A design according to DE-OS 16 35 263 is better, in which the adjustment of the working width of the screen drum is achieved by walls or cover panels on the inside of the screen drum. This adjustability, however, is limited to only a small portion of the entire working width, and in particular, only the marginal areas can be covered in order to be able to use the middle of the drum. It is not good if, for example, only one marginal strip at the outer edge of the screen drum is to remain open, but the remainder of the screen drum is to be covered.

Such a case occurs, for example, when drying fleece, paper or tissue which, when production begins, approach the continuous system at the same very high speed of 600 m/sec. or more, for example. Production of these goods, however, cannot begin over the entire working width of 2 to 5 m because the web must first be threaded around the many rolls and through the various processing assemblies in the continuous system. At the high feed rate, this is only possible with a narrow strip which must run on the operating side of the continuous system. But this narrow strip must likewise emerge dry from the dryer, and hence solidified, because otherwise the goods cannot be handled, at least they cannot be threaded into the system.

Covering the working width of the screen drum except for this narrow strip, however, is not possible with known devices so that, in the past, the industry has been starting with the entire working width and drying the web as required. Then, however, the web is cut lengthwise, leaving a narrow remainder, while the wide part of the web is sent into the basement as scrap, so that only the remaining narrow strip can be threaded into the system. This method of beginning production consequently involves considerable losses. It is not possible to produce and dry only the narrow strip because when the entire working width of the drum is open, the strip will not dry on the drum. The air leakage is too great for effective drying to be possible in the heat treatment chamber. Consequently, the narrow, non-presolidified strip could not be manipulated after passing through the heat treatment device. The strip does not have the necessary strength, and it tears.

SUMMARY OF THE INVENTION

Hence an object of the invention is to develop a drum device by which the above-mentioned disadvantages can be overcome. The goal is also to be able to dry completely and hence solidify only a narrow strip on the heat processing drum. Then the system can be easily threaded without involving the considerable material losses that formerly occurred.

Taking its departure from the known drum device initially described, the invention provides, for achieving the stated object, that the degree of permeability of the baffle cover can be increased to a maximum temporarily, at least over a partial area of the working width Hence, to start the system, the screen drum does not have to have its working width limited by inner cover panels, for example, in its through-flow area, but the effective opening width of the baffle cover is opened further to concentrate the air flowing through to the necessary working width.

This avoids a telescopically overlapping sheet being pulled over the non-used width of the baffle cover to prevent the influx of air; instead, a portion of the baffle cover is rendered ineffective as a baffle cover. This is possible by pushing a partial area of the baffle cover over an adjacent area, so that no baffle cover exists in the partial area or by providing the baffle cover in the partial area with a device to increase air permeability. This can, advantageously, consist of pivotable flaps which are adjustable to open the baffle cover in this partial area.

Another solution is advantageous when the baffle cover has associated with it, at least partially, a parallel aligned screen cover directly against and axially parallel thereto, whose holes in the cross section in the sliding direction are larger or at most equal to those of the baffle cover. To concentrate the incoming air, a screen panel which is likewise perforated is slid only slightly over the baffle cover so that with a limited working width, only those holes that are not required will be covered by this additional screen cover. Then the screen panel is moved, for example, by less than a portion of a hole.

In this initial embodiment, the idea is to leave the perforations in the baffle cover in the type known previously and only enlarge partially the holes in the screen cover matching the degree of displacement. It is important to note in this regard that after the narrow strip of web material is threaded into the entire system, the web of material does not run suddenly over the entire working width, but can reach this working width only slowly. Consequently, the baffle cover must not abruptly become air-permeable over its working width, but instead the active holes in the baffle cover should open only as the working width increases.

An improved solution of the basic idea according to the invention in which the baffle cover itself has associated with it, a parallel aligned second screen cover immediately adjacent to it and displaceable axially parallel thereto, is provided wherein the perforations in the baffle cover, as well as those in the screen cover, should be larger in a cross section in the displacement direction by a multiple in a marginal area of the cover than would correspond to the required flow cross section of the holes to form a baffle cover. This has the advantage that in the area of the screen drum in which the narrow strip runs around the drum, a large free cross section is available in the baffle cover so that when the other perforations over the working width of the baffle cover are uncovered by this large free opening or space, approximately 100% of the incoming accumulated air can also reach the screen drum through this large free opening. 100% drying of only this narrow strip is the consequence of this measure.

Now if the web of material is fed as a narrow strip into the entire system, the production of the strip can be slowly expanded to the provided width of the web. At the same time, only a slight displacement of the screen cover with respect to the baffle cover creates a situation in which the corresponding airflows in, corresponding to the increase in the working width of the screen drum as well.

The arrangement and the size of the holes in both the screen cover and baffle cover are dimensioned so that as close to 100% as possible of the incoming air volume can flow through the open perforations to the drum. If only the narrow strip is to be dried, the holes provided in the vicinity of this strip are given a maximum cross section while the other holes are automatically covered. If the working width after final starting of the device is increased, depending on the increase in the number of holes, the perforation cross section of the holes in the baffle cover is reduced overall so that 100% of the incoming air can now flow onto the screen drum after being held back over the larger area. Finally, the previously conventional stagnant air can flow uniformly over the working width of the screen drum, so that all the holes over the working width of the baffle and screen covers can form a uniform opening cross section together.

There is a space in the processing chamber between the baffle cover and the screen drum. Because the screen drum jacket is not covered, there is a major risk that the air flowing through the open area of the baffle cover will be drawn diagonally into the area of the screen drum which is not covered by material. To prevent this as much as possible, the invention also provides that between the baffle cover and the drum, one, or with spacing several, radially directed walls are disposed around the drum with slight spacing Walls of this kind prevent axially directed improper ventilation of the drum.

It is also advantageous to provide in the apparatus, a device that measures the width of the web of the incoming material, said device being functionally connected with a displacement device for the screen cover with respect to the baffle cover, in order thereby to adjust exactly the width of the material coming onto the screen drum with the position of the screen cover relative to the baffle cover and hence exactly with respect to the open inflow openings.

BRIEF DESCRIPTION OF THE DRAWINGS

The accompanying drawings show embodiments of the device according to the invention. Further inventive details will be described in detail with reference to these embodiments, which are of inventive significance in conjunction with the basic design, wherein.

Figure 1:
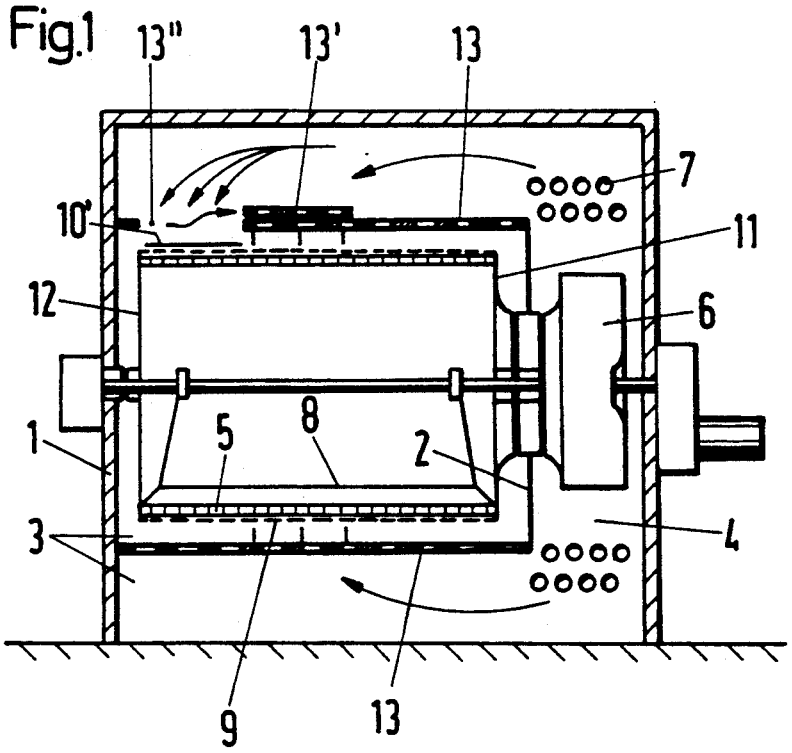
FIG. 1 is a cross section through a screen drum device taken along the longitudinal axis of the screen drum.
Figure 4:
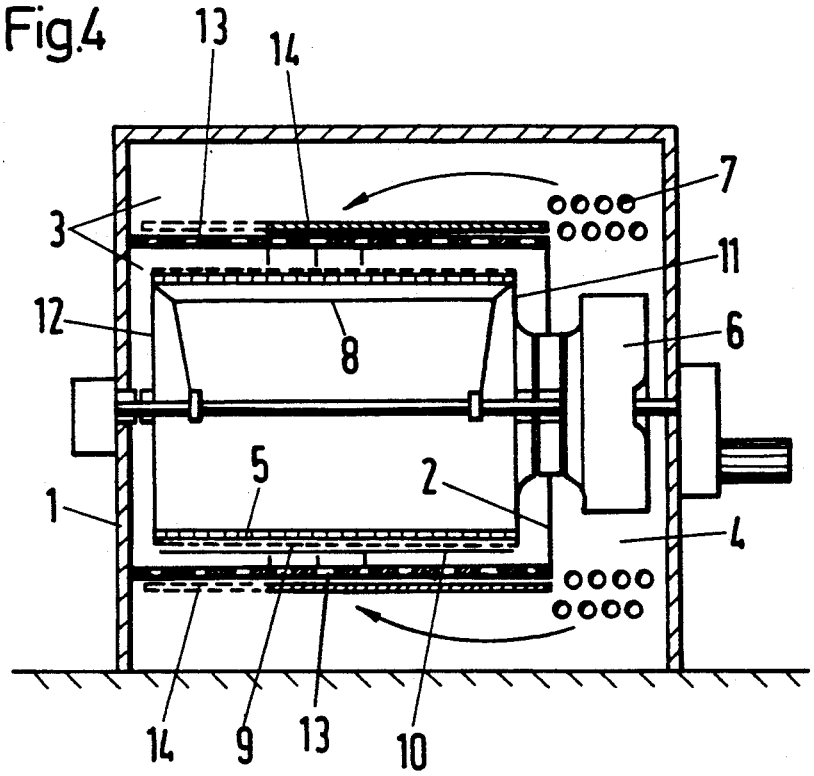
FIG. 4 is a section similar to that shown in FIG. 1.

The screen drum device according to FIGS. 1 and 4 consists of a rectangular housing 1 divided by a partition 2 into a processing chamber 3 and a fan chamber 4. In processing chamber 3, a screen drum 5 is rotatably mounted and concentrically to the drum, in the fan chamber 4, a fan 6 is also rotatably mounted. The fan chamber can also be located in a separate fan housing, not shown. In any case, the fan subjects the interior of the screen drum 5 to a vacuum through an open end of the drum. In addition, the drum design for a wet processing device, which can also serve only to draw liquid away or for wet needling of fleece, is a part of the invention. The entire design must then be adapted accordingly.

Figure 8:
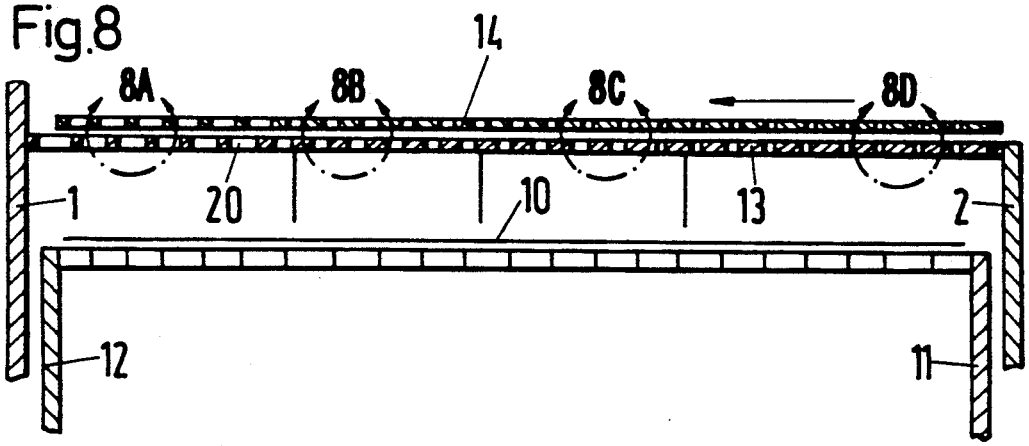
FIG. 8 shows the baffle cover design in FIG. 7 but with a screen drum covered over the entire working width by material to be processed and FIGS. 8A, 8B, 8C and 8D, respectively, show partial enlargements of the baffle cover design corresponding to the circular segments shown in FIG. 8.
Figure 8B:
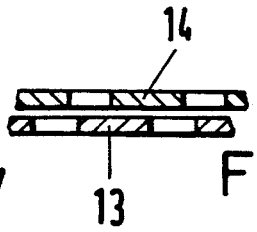
Figure 8D:
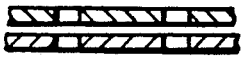
Figure 8A:
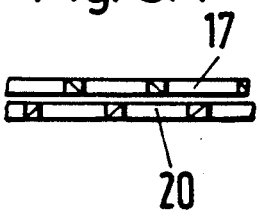
Figure 8C:
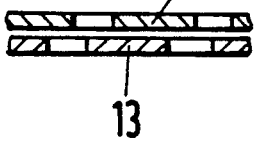

According to FIGS. 1 and 4, heating assemblies 7 are located above and below the fan 6 in the fan chamber 4, the assemblies consisting of tubes traversed by heating medium. In general, the screen drums with the jacket structure of this invention, which is up to 96% air permeable, are built with a very large diameter. Screen drum 5, during heat treatment, is covered over almost the entire circumferential surface with a fabric or paper 10 to be processed (FIGS. 4 and 8). Where the material is applied and removed again, however, the drum is shielded internally from the suction prevailing inside.

Therefore, in FIGS. 1 and 4 inner covering 8 is shown which, however, in this embodiment could be mounted fixed at the level of the drum axis. A fine-mesh screen 9 shown only in FIGS. 1 and 4 is wrapped around the outside of screen drum jacket 5; this screen is fastened to the ends of the drum at the two sides 11 and 12.

A baffle cover 13 is mounted around drum 5 between housing wall 1 and partition 2. With a series arrangement with several screen drums, the baffle cover extends horizontally; in a single drum device, the baffle cover can also extend at a constant distance around the drum.

The screen drum device according to the subject of the invention offers the option of drying, within a short time, a web of material 10' with a lesser web width, without screen drum 5 having to be provided with an expensive design for limiting the air permeability to the width of the web. There are several possibilities for this, all of which concentrate only on the design of baffle cover 13. According to FIG. 1, the baffle cover 13, which here again extends over the entire working width of screen drum 5, in the area where narrow web 10' rests on the screen drum and is to be treated there, consists of circular segments 13' which, in the case of processing web 10', are pushed outwardly out of their normal functional position and then pushed parallel to the axis of the screen drum over fixed baffle cover 13. This produces in the vicinity of web 10' an area 13" which is free of the baffle cover so that the processing air now accelerated by fan 6 over heating device 7 flows mainly through this annular slot (13") and the web of material 10' is processed more intensively, so that the rapid drying can be expected. Of course, baffle cover segments 13' can be replaced by a second circular baffle cover offset radially outward, which then slides in the manner of a ring over baffle cover 13.

Figure 2:
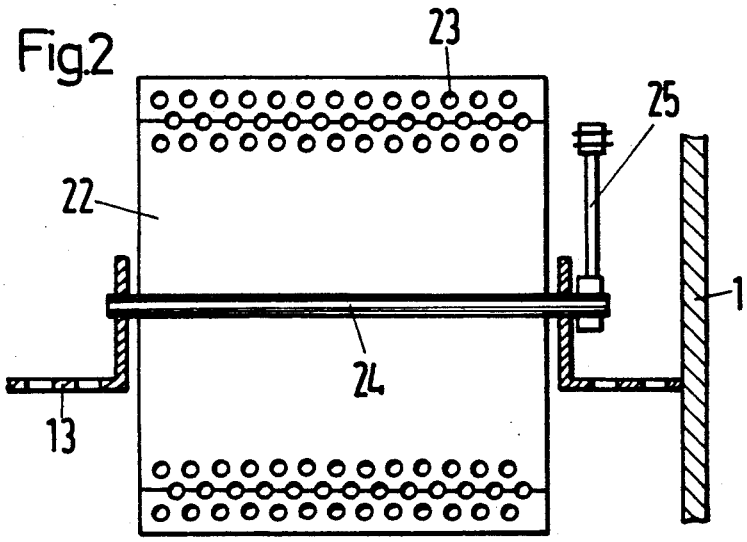
FIG. 2 is a partial enlarged view of a flap adjustment mechanism for the screen drum.
Figure 3:
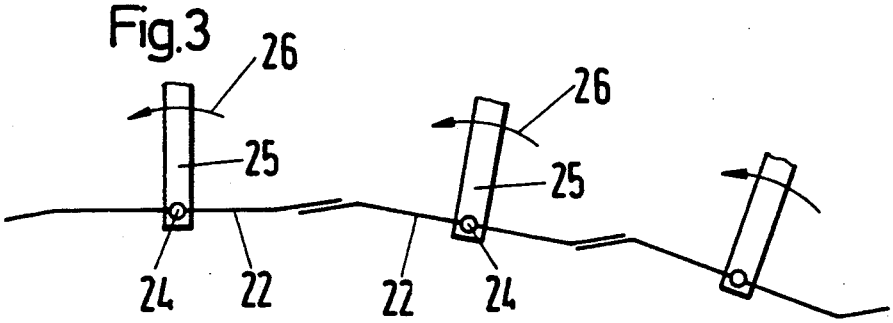
FIG. 3 is a side view of the flap adjustment mechanism according to FIG. 2.
Figure 5:
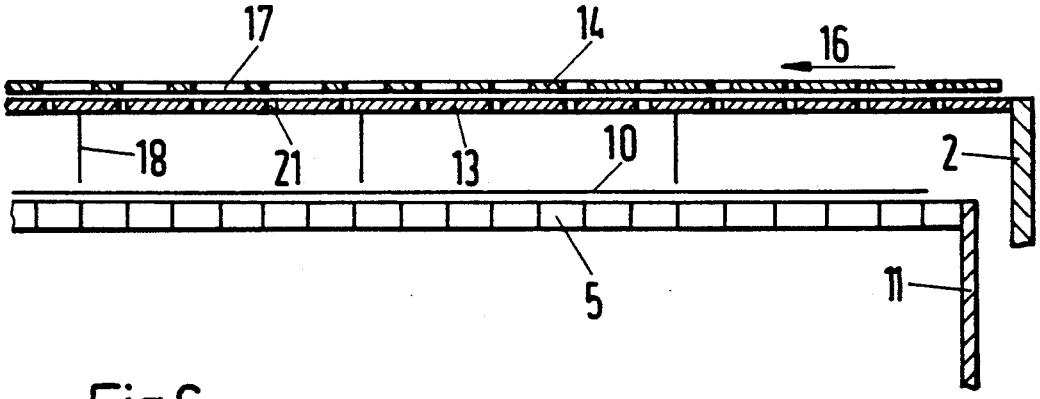
FIG. 5 is a partial enlargement of the screen drum jacket with associated baffle cover with material extending over the entire working width of the drum.

A device can also be provided in free annular slot 13" by which the air permeability of baffle cover 13 can be increased when necessary. According to the embodiment shown in FIGS. 2 and 3, this consists of circularly arranged pivotable flaps 22 which are movable in this partial area to open the baffle cover. For this purpose, a section of the baffle cover 13, as shown in FIG. 2, is bent upward to form flange 30 in the area where the cover is subjacent to web 10'. The respective axis 24 of a flap 22 is mounted in the flanges, said flap being mounted, i.e. to rotate or swing about the axis 24. To swing or rotate about axis 24, a lever mechanism 25 is used which can be connected with a corresponding drive for simultaneous actuation of all flaps 22 around drum 5 in simple fashion. In the event of an opening, in other words, drying of web 10', flaps 22 are rotated as shown in FIG. 2 so that the flaps are substantially perpendicular to the cover 13. If, on the other hand, a web 10, being dried as shown in FIG. 4, extends over the entire working width of drum 5, flaps 22 are rotated through 90 degrees and thus, as shown in FIG. 3, partially rest on one another. So that in this case, air can flow through this area of the baffle cover as well, flaps 22 are provided with holes 23 so that the air permeability corresponds to that of the other section of the baffle cover 13. The flaps according to FIG. 3 are bent at their outer ends over the screen cover is slid to the right (arrow 15), the through openings 21 of the baffle cover 13 are opened successively until the displacement position shown in FIG. 5 is reached and all the openings are permeable. Accordingly, in FIG. 5, web 10 also extends over the entire working width of screen drum 5.

Figure 6:
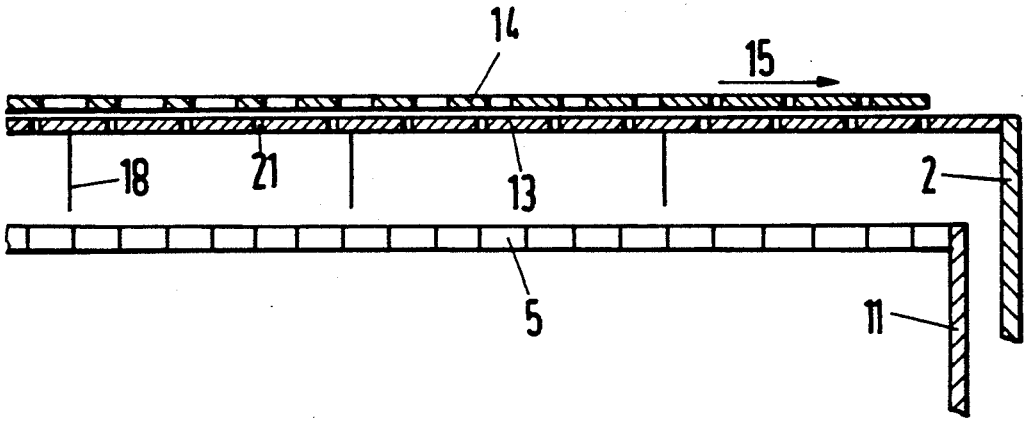
FIG. 6 is a partial enlargement according to FIG. 5 with the screen cover shifted to the left in such a manner that the holes in the baffle cover which are on the right side are covered by the screen cover.

As shown in FIGS. 5 and 6, the holes in baffle cover 13 are of a constant size, such a size that the desired baffle pressure results in the baffle chamber The holes in screen cover 14 increase in cross section in sections toward the left; namely only in displacement direction 16. Therefore, when screen cover 14 is displaced to the left (arrow 16), first the through holes located at the far right are closed. Then the next group, and so on, while the holes in baffle cover 13 that are located further to the left remain open because of the shape of the elongated holes 17. The openings of elongated holes 17 can also become continuously larger.

Figure 7:
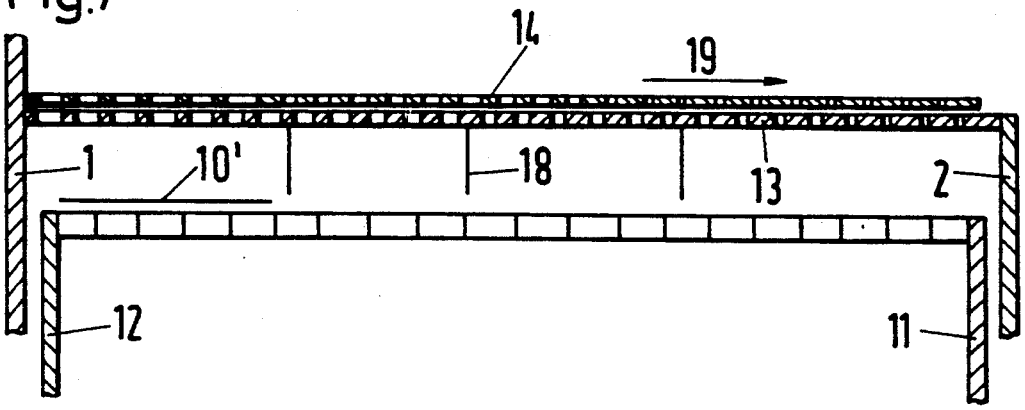
FIG. 7 is a partial enlargement of the screen drum with associated baffle cover of a different design and a screen drum only partially covered with material.

The special arrangement according to FIGS. 7 and 8 is even more advantageous. Here the perforations or holes in both baffle cover 13 and in screen cover 14 have different through-put cross sections. The goal is for those holes in the covers which remain open simultaneously, 100% permeability for the processing air is always achieved, which would be necessary if screen drum 5 were completely covered with web 10 as shown in FIG. 5. Therefore, elongated holes 17 in FIG. 7 are very large in the vicinity of narrow web 10'. A great deal of air flows through the very narrow open screen cover and optimally surface in order to achieve a better contact of the flaps in the closed state. To open the flap mechanism, levers 25 are then pivoted in the direction of arrows 26.

In addition to a normal baffle cover 13, in the device shown in FIGS. 4–8, a screen cover 14 is also provided parallel to and immediately adjacent to said device. According to FIG. 4, the screen cover leaves an area free on the operating side (drive side of drum 5); screen cover 14 can pass through, however, as indicated by the dashed line. The two covers 13 and 14 are mounted to be displaceable with respect to one another. Displacement serves to change the through-flow area of baffle cover 13 and/or to open and close the through-flow openings in the baffle cover. The goal is to allow the air accelerated by the fan to pass through the baffle cover only at points where the air can also strike material 10, 10' resting on drum 5. The rest of the openings in the screen cover and baffle cover are supposed to be closed.

In the embodiment shown in FIG. 4, on the left side (drive side) an area of the baffle cover 13 without screen cover covering 14 is associated with the drum 5.

Only this strip of material is to be dried while the remaining area of the drum remains unused. Therefore, according to FIG. 6, the remaining holes in baffle cover 13 are covered by the ribs of the holes of screen cover 14. Of course, screen cover 14 can also extend in the left-hand area over the baffle cover. Then only the holes in the baffle cover need to be flush with those in the screen cover. When the processes material 10'; in other words so that the material is discharged dry after going around screen drum 5. The holes outside the area of the web 10' are closed again.

Transverse ventilation, flowing in the axial direction of the air to the flow area of screen drum 5 which has remained open is prevented by partitions 18 which radially extend from baffle cover 14 approximately to the surface of the screen drum. Therefore, only radially directed air flow can result.

If the web of material 10' which has solidified after drying is then threaded into the entire system, normal production can begin. The web is slowly widened to the working width of the screen drum. The width of material 10' is scanned at the input to the screen drum. Accordingly, screen cover 14 shifts in the direction of arrow 19. Then the adjacent elongated holes open in succession; they are smaller in cross section because, when the following holes 17 are fully open, all of the air must be distributed over a larger area of the screen drum. If the screen drum according to FIG. 8 is then covered completely by material 10, the air flows uniformly over the width onto the material with the throughput openings being of the same size everywhere in both the screen cover and baffle cover (see partial enlargements corresponding to circular segments in FIG. 8).

It is evident that for opening the holes over the working width or for correspondingly closing them, only a small displacement of screen cover 14 relative to baffle cover 13 is necessary. It depends on the hole configuration of the covers. The displacement range is, therefore, less than or slightly more than only one hole division.

What is claimed is:

1. A device for through-flow processing of web-shaped material with a fluid processing medium that is circulated in the entire device by a fan, said device comprising a drum that is fluid permeable and traversed from the outside to the inside by said processing medium, said drum being under suction, having non-perforated plates at its ends, and providing a transport element for the web-shaped material, and a baffle cover for forming a baffle chamber in front of a processing chamber, said baffle cover being arranged parallel to an axis of the drum and having holes located transversely over a working width of the drum, the processing medium permeability of said cover being less than that of the drum, characterized in that means are provided so that the degree of permeability of the baffle cover is temporarily increasable to a maximum over at least a partial area of the working width of the drum.

2. A device according to claim 1, characterized in that the baffle cover is temporarily open over a partial area of the working width of the drum.

3. A device according to claim 1 or 2, characterized in that the baffle cover in a partial area is provided with the means for increasing the air permeability.

4. A device according to claim 3, characterized in that the means consists of pivotable flaps which can be raised to open the baffle cover in this partial area.

5. A device according to claim 4, characterized in that the flaps are made with perforations over their surface.

6. A device according to claim 5, characterized in that the perforations in the flaps are so designed that the air permeability of the flaps which are parallel to the baffle cover and which are aligned to be closed, is equal to that of the remainder of the baffle cover.

7. A device according to claim 1, characterized in that the means comprises another cover which can be slid against and over the baffle cover arranged parallel to the axis of the drum.

8. A device according to claim 7, characterized in that a part of a baffle cover is mounted so that it can be displaced laterally out of a partial area, and so that the partial area is completely open.

9. A device according to claim 7, characterized in that a baffle cover has associated with it at least partially one parallel aligned screen cover arranged directly parallel to and displaceable axially parallel thereto, whose holes are made with cross-sections in a displacement direction larger than but at most equal to, those of the baffle cover.

10. A device according to claim 7, characterized in that the baffle cover has associated therewith a parallel aligned screen cover arranged directly parallel to and displaceable axially parallel thereto, and holes in the baffle cover and in the screen cover in cross section in a displacement direction in a marginal area of the baffle cover being a larger size than that size which corresponds to a flow cross section of holes required to form a simple baffle cover.

11. A device according to claim 9, characterized in that holes in the screen cover are designed to have different cross sections over the working width.

12. A device according to claim 10, characterized in that holes of the screen cover and of baffle cover are designed to have different cross sections over the working width.

13. A device according to claim 11, characterized in that the holes of the screen cover are made successively smaller in cross section toward one outer edge of the screen cover.

14. A device according to claim 12, characterized in that the holes of the screen cover and in the baffle cover are made progressively smaller in cross section toward one outer edge of the screen cover.

15. A device according to claim 13, characterized in that the holes of the screen cover are designed to be continuously smaller in cross section.

16. A device according to claim 14, characterized in that the holes in the screen cover and the baffle cover are designed to be continuously smaller in cross-section.

17. A device according to claim 13, characterized in that the holes in the screen cover are designed to become smaller in cross section in segments over the working width.

18. A device according to claim 14, characterized in that the holes of the screen cover and of the baffle cover are designed to become smaller in cross section in segments over the working width.

19. A device according to claim 9, characterized in that an area of the baffle cover remaining uncovered by the screen cover.

20. A device according to claim 19, characterized in that an area of the baffle cover that remains free is provided on and end of the baffle cover.

21. A device according to claim 19 or 20, characterized in that a part of screen cover adjacent to an area of the drum which is not covered by the screen cover has larger holes so that the holes slowly decrease in cross section toward the outer edge of the screen cover associated with the fan up to, at most, the cross section of holes of the baffle cover.

22. A device according to claim 19 or 20, characterized in that the holes of the baffle cover are made with a larger cross section in the area not covered by the screen cover than other holes arranged over a working width of the baffle cover.

23. A device according to claim 22, characterized in that the screen cover extends over the entire baffle cover over the area with the larger holes of the baffle cover, and the ribs of the screen cover when the screen cover is slid to open the other holes of the baffle cover, close off the larger holes of baffle cover partially.

24. A device according to claim 10 characterized in that both baffle cover and screen cover are provided with cross sectional holes which are large in a displacement direction and these holes slowly decrease in cross section toward the outer edge of the screen cover associated with the fan up to, at most, the cross section of the smallest holes of the baffle cover.

25. A device according to claim 23 or 24, characterized in that when the holes are flush with the large cross-section holes on the drive side of the device, the holes in the remaining area of the cover, cover one another, and are sealed in terms of flow.

26. A device according to claim 25, characterized in that upon displacement of the screen cover from a position in which large holes are flush and thus reduce a throughflow cross section, the holes arranged toward the fan side, which cover one another mutually, are successively opened.

27. A device according to claim 1, characterized in that the means includes a screen cover and a displacement range of the screen cover relative to the baffle cover is dimensioned to vary from less than to slightly more than one hole division.

28. A device according to claim 27, characterized in that, after terminating displacement of the screen cover by less than one hole division, the free flow cross section of all the holes of the two superimposed baffle and screen covers is the same size over the area of baffle cover.

29. A device according to claim 1, characterized in that between the baffle cover and the drum, at least one radially directly wall is fastened around and spaced with a slight distance, around the drum on the baffle cover.

30. A device according to claim 1, characterized in that said means includes a screen cover on the device, said device including another means for measuring the width of the web of the incoming material, said measuring means being functionally linked with a displacement device of the screen cover.

* * * * *